US010311699B2

(12) United States Patent
Tepper

(10) Patent No.: US 10,311,699 B2
(45) Date of Patent: Jun. 4, 2019

(54) SWIMMING POOL ENTRANCE DETECTOR

(71) Applicant: Amos Tepper, Nes Ziona (IL)

(72) Inventor: Amos Tepper, Nes Ziona (IL)

( * ) Notice: Subject to any disclaimer, the term of this patent is extended or adjusted under 35 U.S.C. 154(b) by 0 days.

(21) Appl. No.: 16/092,445

(22) PCT Filed: Apr. 4, 2017

(86) PCT No.: PCT/IL2017/050411
§ 371 (c)(1),
(2) Date: Oct. 10, 2018

(87) PCT Pub. No.: WO2017/183021
PCT Pub. Date: Oct. 26, 2017

(65) Prior Publication Data

US 2019/0108745 A1 Apr. 11, 2019

(30) Foreign Application Priority Data

Apr. 21, 2016 (IL) ..... 245341

(51) Int. Cl.
*E04H 4/10* (2006.01)
*G08B 21/08* (2006.01)

(52) U.S. Cl.
CPC ..... *G08B 21/082* (2013.01); *E04H 4/10* (2013.01)

(58) Field of Classification Search
None
See application file for complete search history.

(56) References Cited

U.S. PATENT DOCUMENTS 3,603,952 A 9/1971 Smith
4,203,097 A * 5/1980 Manning ..... E04H 4/06 340/566
5,184,356 A * 2/1993 Lof ..... E04H 4/101 4/498
6,384,726 B1 * 5/2002 Epple ..... E04H 4/101 340/545.6
2005/0012629 A1 * 1/2005 Shebek ..... G08B 5/36 340/679
2006/0033627 A1 * 2/2006 Esson ..... E04H 4/06 340/573.6
2011/0241887 A1 * 10/2011 McKinney ..... G08B 21/088 340/573.6
2013/0313204 A1 11/2013 Shalon et al.

OTHER PUBLICATIONS

WO2017183021 PCT Search Report, dated Jul. 13, 2017.
WO2017183021 PCT Written Opinion, dated Jul. 13, 2017.

* cited by examiner

*Primary Examiner* — Thomas S McCormack
(74) *Attorney, Agent, or Firm* — Alphapatent Associates, Ltd; Daniel J. Swirsky

(57) ABSTRACT

A swimming-pool entrance detector (10*a*), including: means (50) for disposing the swimming-pool entrance detector (10*a*) in water of a swimming pool (12) above the ground (56) thereof; and a first optical sensor (30), for receiving optical rays (40*a*1, 40*a*2), thereby receipt of the optical rays (40*a*1, 40*a*2) may indicate presence of at least one opening (14*a*) in a cover (18) of the swimming pool (12).

8 Claims, 7 Drawing Sheets

FIG 1 - PRIOR ART

SWIMMING POOL ENTRANCE DETECTOR

CROSS-REFERENCE TO RELATED APPLICATIONS

This application is a U.S. National Phase Application under 35 U.S.C. 371 of International Application No. PCT/IL2017/050411, which has an international filing date of Apr. 4, 2017, and which claims priority and benefit from Israel Patent Application No. 245341, filed Apr. 21, 2016, the contents and disclosure of which are incorporated herein by reference in their entirety.

TECHNICAL FIELD

The invention relates to the field of swimming pools safety. More particularly, the invention relates to a detector for indicating an entering to the swimming pool.

BACKGROUND

FIG. 1 depicts a swimming pool, and the problem concerned.

A swimming pool 12, while not being used, must be covered by a cover 18, for protecting of the accidental entrance of children and the like while the swimming pool is not guarded, and prevention of accidental drowning.

However, children might enter by creating an opening of the pool cover 14*a* that allows entering the pool.

The conventional solution to the problem is by video means or by motion sensor. However, without super quality and expensive means, these solutions provide false alarms, as they can alert also in other irrelevant cases and not just focused to the case to be indicated.

US20130313204 discloses light sensors to determine whether an spa is covered or not.

However, US20130313204 does not provide a solution for alerting upon presence of one of various local/partial openings 14*a* of pool cover 18.

DETAILED DESCRIPTION

Figure 1:
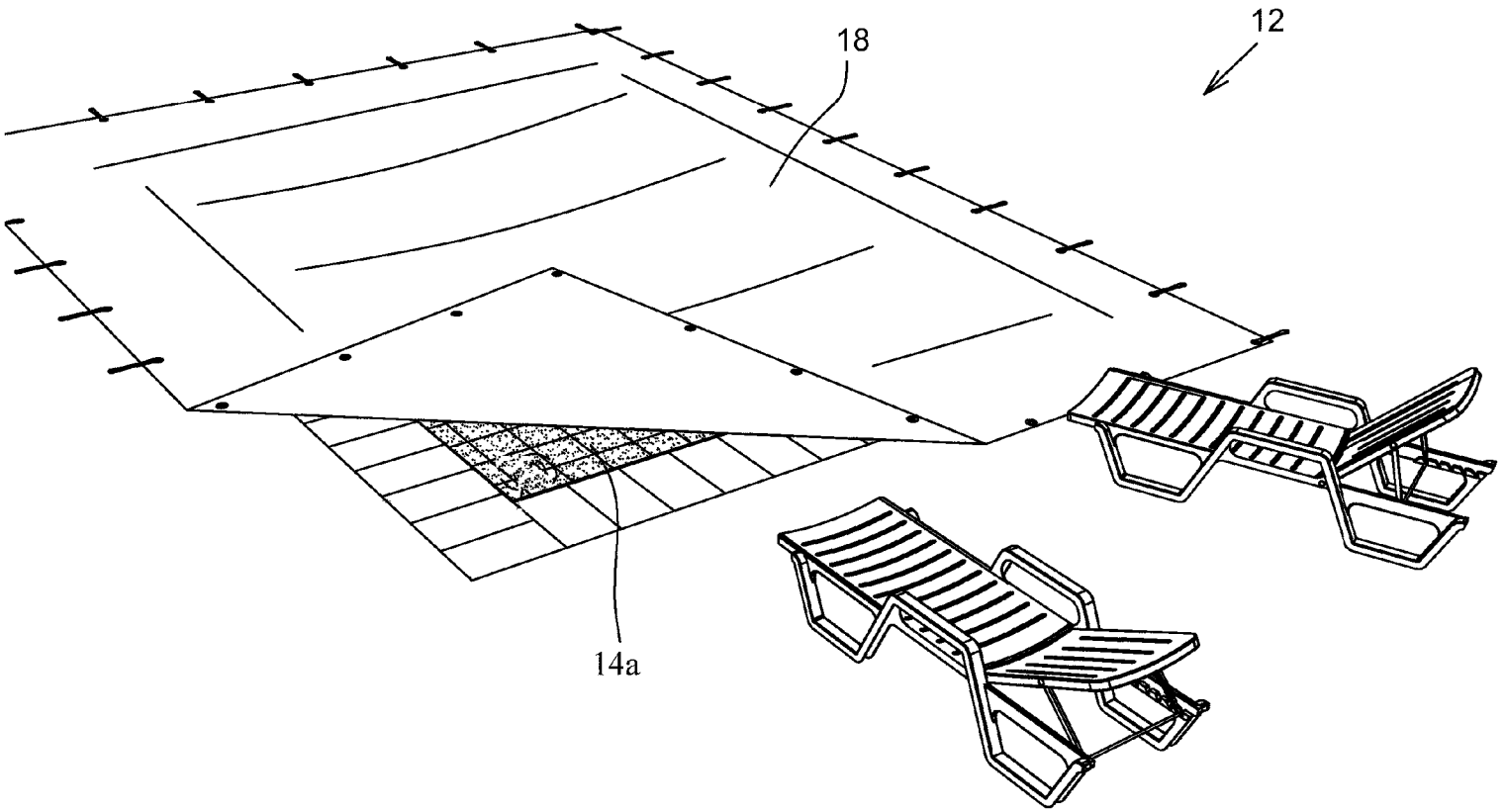
FIG. 1 depicts a swimming pool, requiring indication of an undesired opening of the cover.
Figure 2:
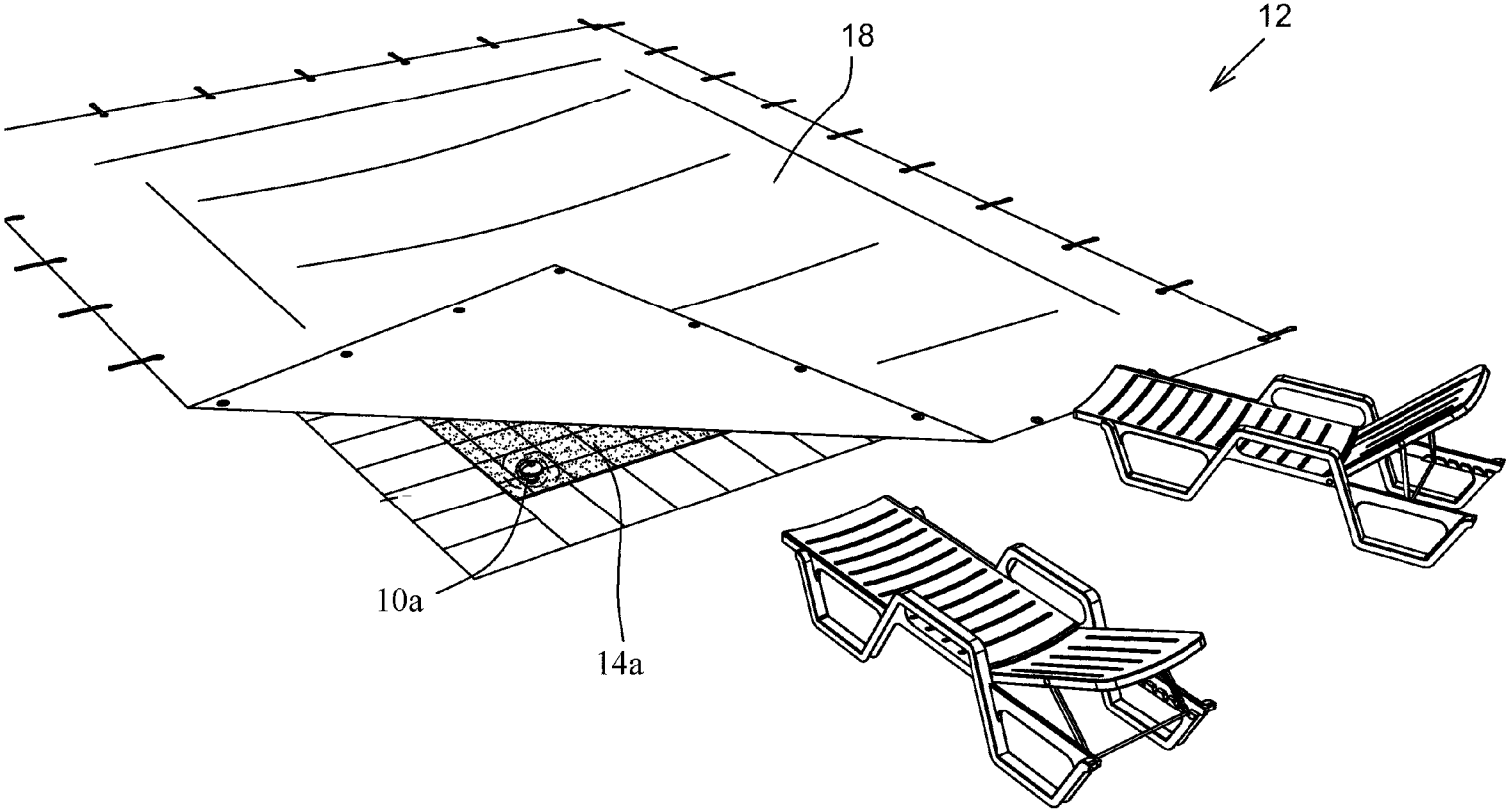
FIG. 2 depicts the swimming pool of FIG. 1, including a swimming-pool entrance detector according to one embodiment of the invention.

FIG. 2 depicts the swimming pool of FIG. 1, including a swimming-pool entrance detector according to one embodiment of the invention.

One or more swimming-pool entrance detectors 10*a* according to the invention may warn upon the creation of opening 14*a*.

Swimming-pool entrance detector 10*a* preferably floats on the water or may be submersed in the water. Unlike depicted in the figure, it is not necessary that swimming-pool entrance detector 10*a* be located against opening 14*a*. Swimming-pool entrance detector 10*a* may also be integrated in the pool structure, for example, the electronic parts of the detector may be integrated, mounted, or attached to the walls of the pool, or to the pool cover.

Figure 3:
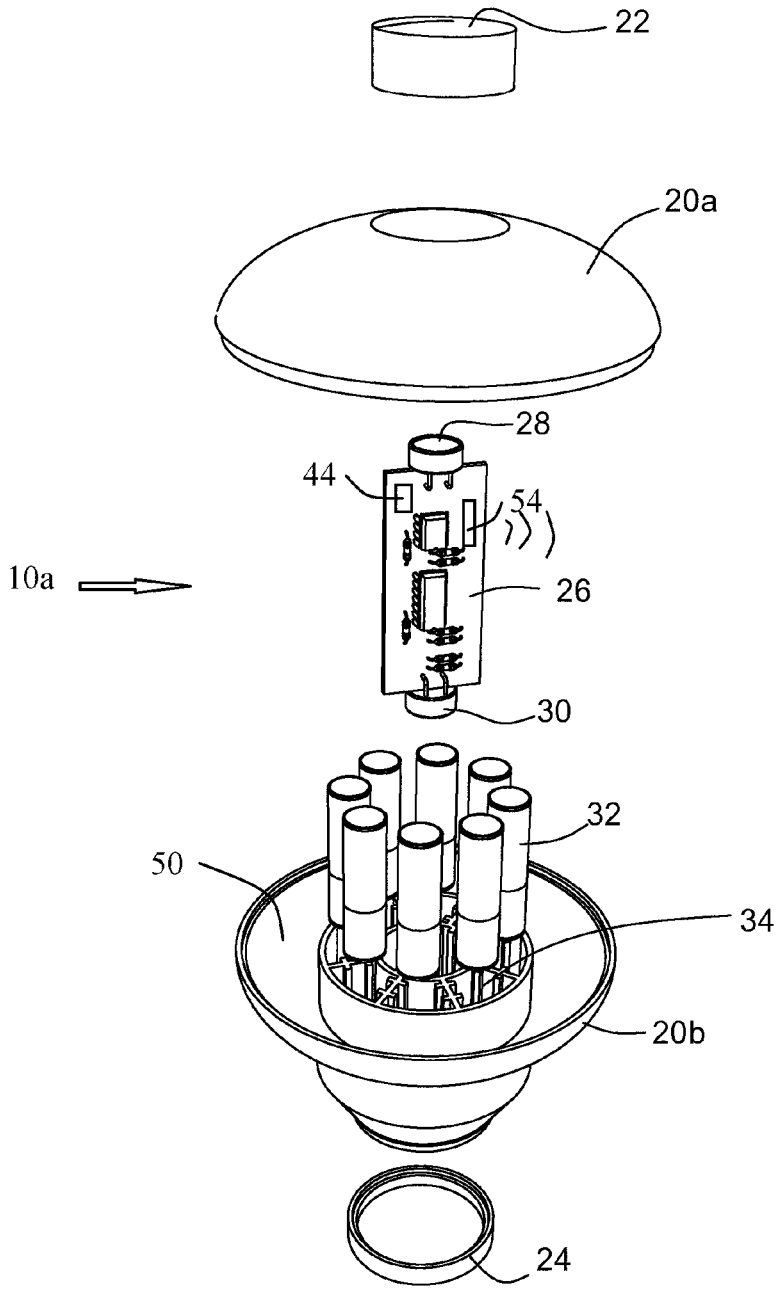
FIG. 3 depicts the swimming-pool entrance detector of FIG. 2 disassembled.

FIG. 3 depicts the swimming-pool entrance detector of FIG. 2 disassembled.

Swimming-pool entrance detector 10*a* can include a sealed compartment 50 for containing air, sufficient for creating some buoyancy. Further to the optical sensing of the cover position, an accelerometer 44 may utilize the floating, for detecting sudden movement, indicating motion of a person disposed within the swimming pool.

Compartment 50 includes casing members 20*a* and 20*b*; a top lens 22, for facing the sky or cover 18 of FIG. 2; and a bottom lens 24, for facing the ground of swimming pool 12 of FIG. 2.

Compartment 50 contains a top optical sensor 28, for receiving illumination through top lens 22; a bottom optical sensor 30, for receiving illumination through bottom lens 24; an electronic unit 26, which may include an alarm unit 54, such as a wireless transmitter; and batteries 32, for powering electronic unit 26.

Figure 4:
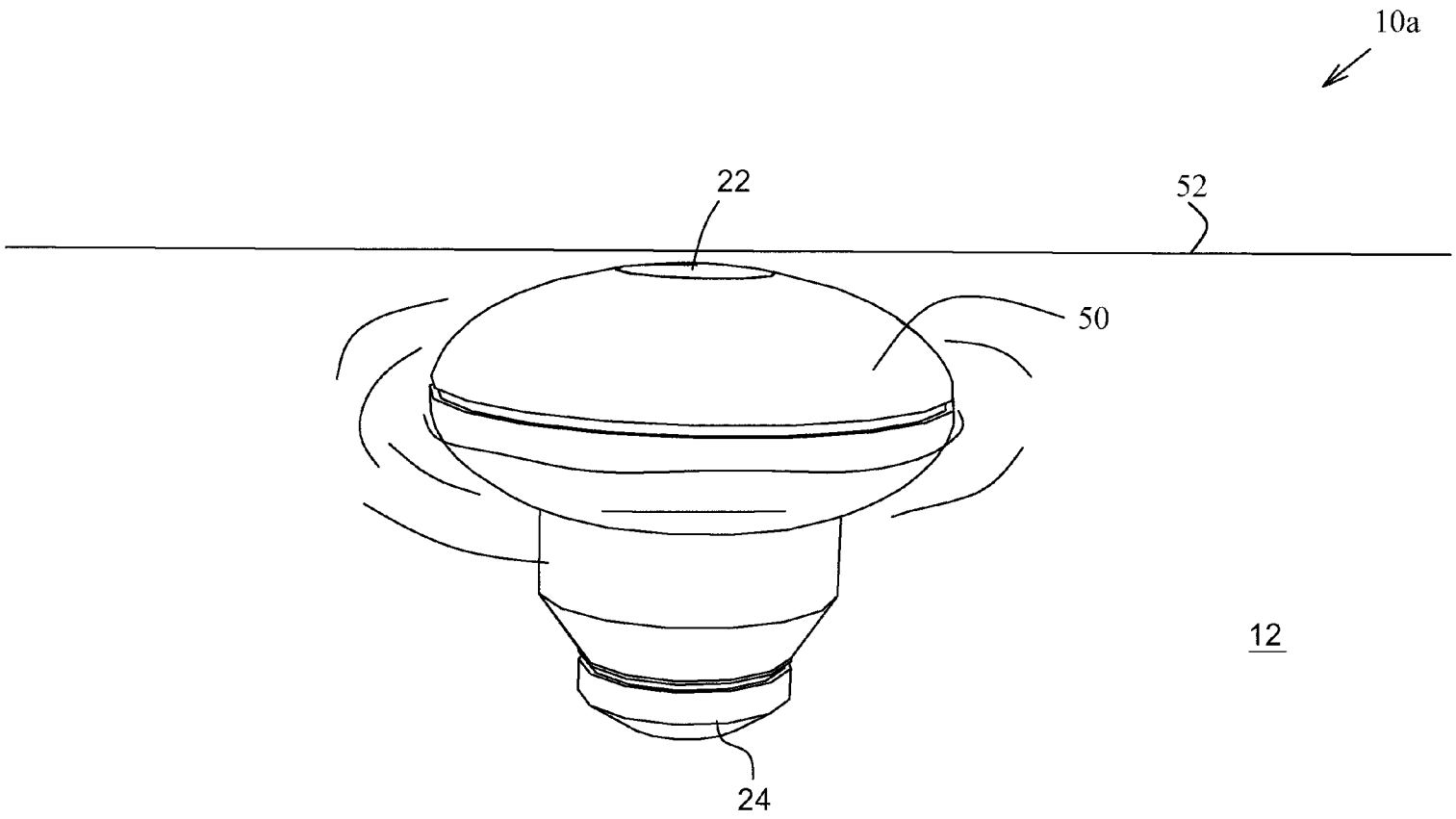
FIG. 4 depicts the swimming-pool entrance detector of FIG. 2 floating in the water of the swimming pool of FIG. 2.

FIG. 4 depicts the swimming-pool entrance detector of FIG. 2 floating in the water of the swimming pool of FIG. 2.

Another function of batteries 32 is for providing weight to swimming-pool entrance detector 10*a*, for lowering the top thereof, such that top lens 22 is disposed underwater near the water level 52. Compartment 50 is shaped and batteries 32 are housed therewithin, such that lens 22 maintains the top position and lens 24 maintains the bottom position.

Figure 5:
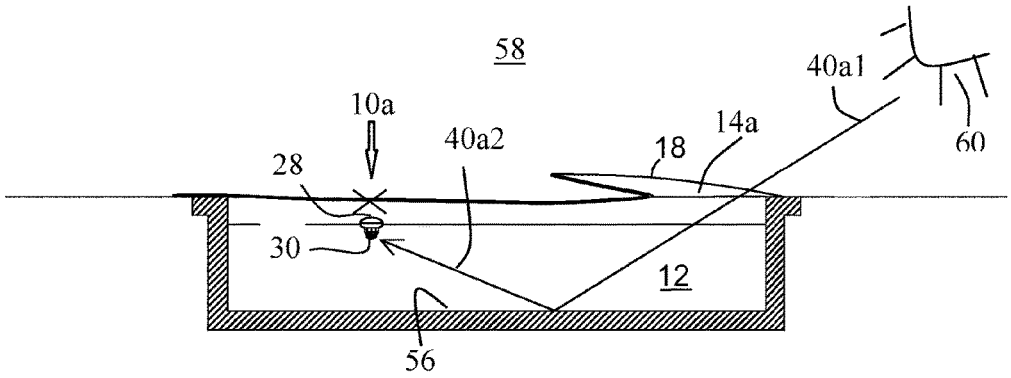
FIG. 5 is a front sectional view of a swimming pool having an opening in the cover and the swimming-pool entrance detector of FIG. 2.

FIG. 5 is a front sectional view of the swimming pool having the opening and the swimming-pool entrance detector of FIG. 2.

Swimming-pool entrance detector 10*a* is disposed above the ground 56, and top optical sensor 28 thereof faces the top 58. Even though opening 14*a* is disposed at the right side of swimming pool 12 and swimming-pool entrance detector 10*a* is disposed at the left side thereof, a ray 40*a*1, such as from the sun 60 being at the top 58, enters opening 14*a*, is reflected to ray 40*a*2, and may disperse towards bottom optical sensor 30. In contrast to bottom optical sensor 30, in this case, ray 40*a*1 does not reach top optical sensor 28, due to cover 18.

Figure 6:
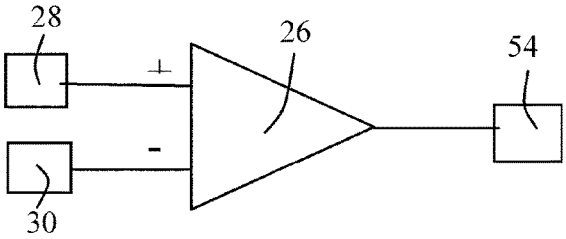
FIG. 6 is an electronic circuit, for showing the principle of the analysis of the electronic unit of FIG. 3.

FIG. 6 is an electronic circuit, for showing the principle of the analysis of the electronic unit of FIG. 3.

Electronic unit 26, which may constitute a comparator for detecting a significant difference between the intensity on top optical sensor 28 and bottom optical sensor 30, analyses presence of opening 14*a*, and thus turns on alarm unit 54.

Electronic unit 26 may further include a memory, for detecting differences along time, for the same sensor, such as described following.

During creating opening 14*a*, electronic unit 26 detects a positive intensity gradient on bottom optical sensor 30 and a non-significant intensity gradient on top optical sensor 28. According to this, electronic unit 26 identifies the creation of opening 14*a*.

Figure 7:
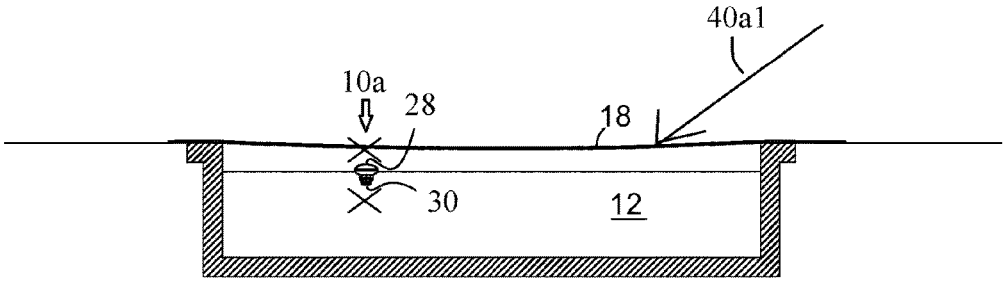
FIG. 7 is a front sectional view of a swimming pool having the swimming-pool entrance detector of FIG. 2, but not having the opening of the swimming pool cover.

FIG. 7 is a front sectional view of the swimming pool not having the opening and the swimming-pool entrance detector of FIG. 2.

In case that opening 14*a* is not present, ray 40*a*1 neither reaches top optical sensor 28, nor bottom optical sensor 30, due to cover 18.

Electronic unit 26 (shown in FIG. 3) detecting equal intensity on top optical sensor 28 and on bottom optical sensor 30, analyses absence of opening 14*a*, and thus turns off alarm unit 54.

Figure 8:
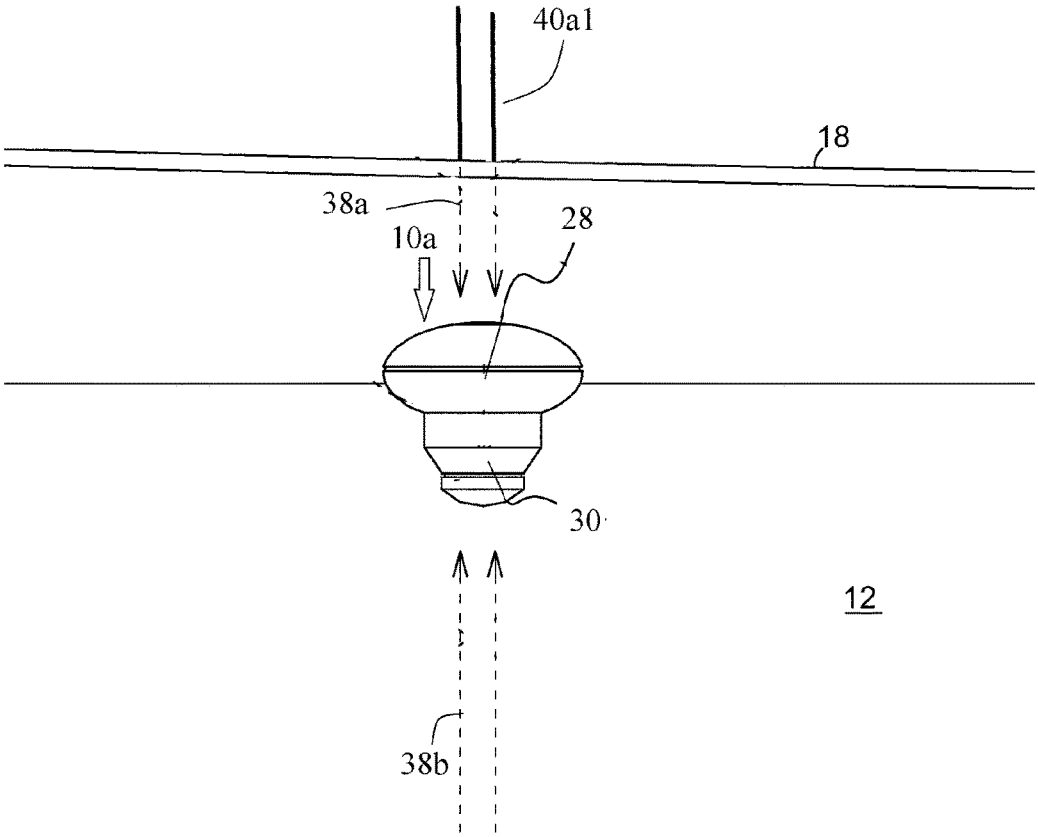
FIG. 8 is a front sectional view of the swimming pool of FIG. 7, in which the cover is partially transparent.

FIG. 8 is a front sectional view of the swimming pool of FIG. 7, in which the cover is partially transparent.

Even if cover 18 partially transfers ray 40*a*1, due to absorbing a portion thereof, electronic unit 26 (shown in FIG. 3) will still detect that the intensity of ray 38*a*, being the remainder of the absorbance, reaching top optical sensor 28, is substantially equal to the intensity of the reflected ray 38*b* reaching bottom optical sensor 30, and thus analyses absence of opening 14*a*, and thus turns off alarm unit 54.

In another aspect, in this case, once the sun gets out of a cloud, electronic unit 26 detects equal difference both to top optical sensor 28 and to bottom optical sensor 30 and concludes absence of opening 14*a*.

Figure 9:
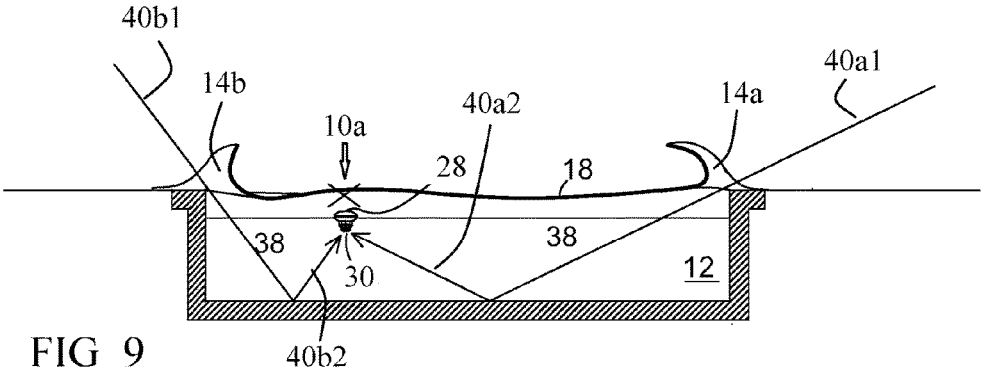
FIG. 9 is a front sectional view of the swimming pool having two openings and the swimming-pool entrance detector of FIG. 2.

FIG. 9 is a front sectional view of the swimming pool having two openings and the swimming-pool entrance detector of FIG. 2.

Even though openings 14*a* and 14*b* are disposed at the right and left sides of swimming pool 12 and swimming-pool entrance detector 10*a* is disposed at the center thereof, rays 40*a*1 and 40*b*1 enter openings 14*a* and 14*b* respectively, are reflected to rays 40*a*2 and 40*b*2 respectively, and may disperse towards bottom optical sensor 30. In contrast to bottom optical sensor 30, in this case, rays 40*a*1 and 40*b*1 do not reach top optical sensor 28, due to cover 18.

Electronic unit 26 (shown in FIG. 3) detecting a significant difference between the intensity on top optical sensor 28 and bottom optical sensor 30, analyses presence of openings 14*a* and 14*b*, and thus turns on alarm unit 54.

Figure 10:
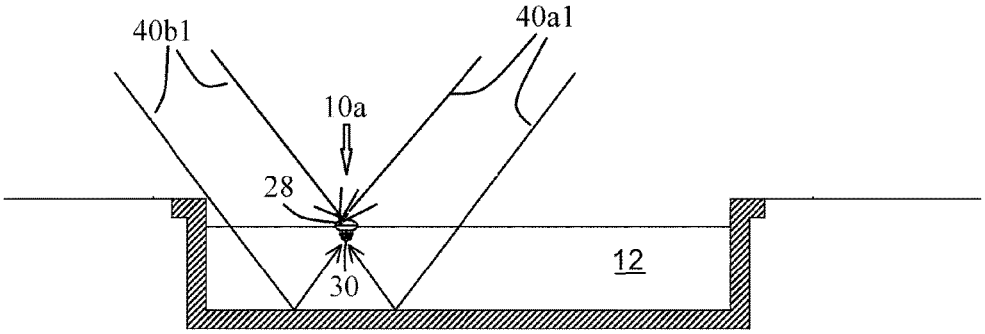
FIG. 10 is a front sectional view of the swimming pool being entirely exposed, and having the swimming-pool entrance detector of FIG. 2.

FIG. 10 is a front sectional view of the swimming pool being entirely exposed, and having the swimming-pool entrance detector of FIG. 2.

Upon removing cover 18, rays 40*a*1 and 40*b*1 enter, are reflected and may disperse towards bottom optical sensor 30. In this case, rays 40*a*1 and 40*b*1 as well reach top optical sensor 28.

Electronic unit 26 (shown in FIG. 3) detecting no significant difference between the intensity on top optical sensor 28 and bottom optical sensor 30, analyses absence of openings 14*a* and 14*b*, and thus turns off alarm unit 54.

Figure 11:
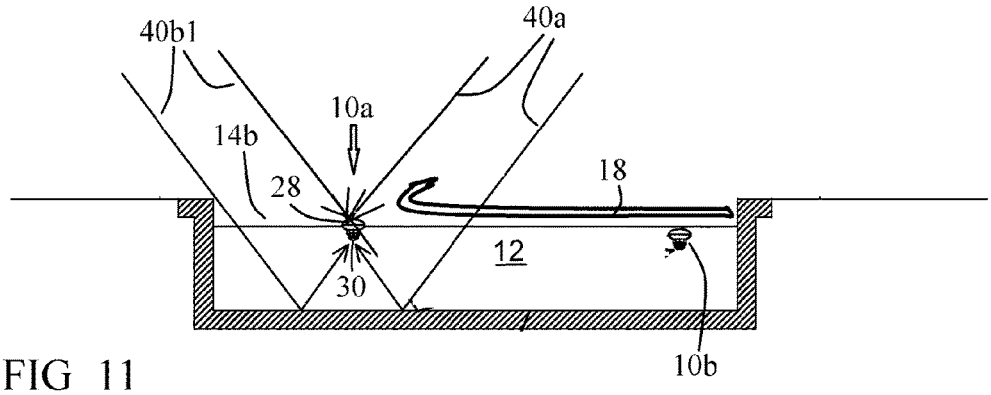
FIG. 11 is a front sectional view of the swimming pool having one of the openings, and the swimming-pool entrance detector of FIG. 2 facing that opening.

FIG. 11 is a front sectional view of the swimming pool having one of the openings, and the swimming-pool entrance detector of FIG. 2 facing that opening.

In this example opening 14*b* is disposed at the left side of swimming pool 12, and swimming-pool entrance detector 10*a* as well is disposed at the left. Ray 40*b*1 enters openings 14*a*, is reflected and may disperse towards bottom optical sensor 30. However, ray 40*a*1 cannot enter opening 14*b* for being reflected towards bottom optical sensor 30.

In contrast to bottom optical sensor 30, in this case, both of rays 40*a*1 and 40*b*1 reach top optical sensor 28, through opening 14*b*.

Electronic unit 26 (shown in FIG. 3) detects the difference between the intensity on top optical sensor 28 and bottom optical sensor 30, analyses presence of opening 14*b*, and thus turns on alarm unit 54.

Figure 12:
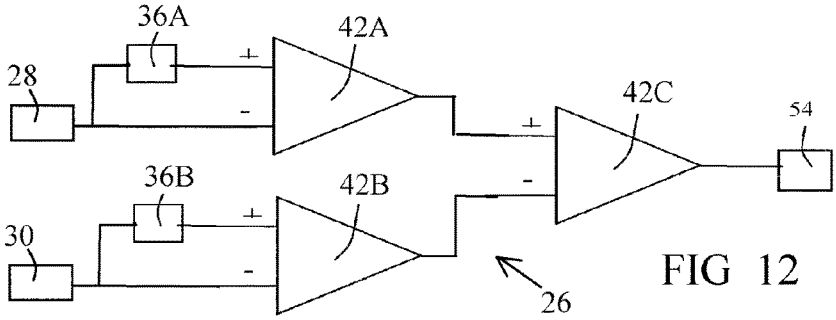
FIG. 12 is an electronic circuit, for showing the principle of the analysis of the electronic unit for the case of FIG. 11.

FIG. 12 is an electronic circuit, for showing the principle of the analysis of the electronic unit for the case of FIG. 11.

The reading of top optical sensor 28 may be stored in a memory 36A, for comparing by a comparator 42A, this reading with the current reading of top optical sensor 28. The reading of bottom optical sensor 30 may be stored in a memory 36B, for comparing by a comparator 42B, this reading with the current reading of top optical sensor 28.

Thus, in another aspect, during creating opening 14*b*, electronic unit 26 detects by a comparator 42C, comparing the outputs of comparators 42A and 42B, that the positive intensity gradient on top optical sensor 28 is greater than the positive intensity gradient on bottom optical sensor 30. According to this, electronic unit 26 identifies the creation of opening 14*b*.

Referring again to FIG. 11, for a large swimming pool, it is preferable to provide swimming-pool entrance detector 10*a* to an additional swimming-pool entrance detector 10*b*, which will not receive ray 40*b*1.

Numerals 10*a* and 10*b* denote swimming-pool entrance detectors according to one embodiment of the invention;

numeral 12 denotes a swimming pool;

numeral 14*a* and 14*b* denote undesired opening in the cover; swimming-pool entrance detectors 10*a* and 10*b* are intended for warning presence of the opening;

numeral 18 denotes a cover of the swimming pool, for not allowing children and the such to enter the swimming pool;

numerals 22 and 24 denote lenses;

numerals 20*a* and 20*b* denote two members of the packaging/casing of the swimming-pool entrance detector, which function together also as a float, since they house air in a sealed manner;

numeral 26 denotes the electronic unit; the main element thereof is a comparator, which may be electronic or a controller, for comparing the signal of the top optical sensor 28 with the signal of the bottom optical sensor 30;

numeral 28 denotes the optical sensor disposed at the top;

numeral 30 denotes the optical sensor disposed at the bottom;

numerals 32 denotes a battery for powering the swimming-pool entrance detector;

numeral 34 denotes a subsidiary compartment for housing one or more batteries;

numerals 36A and 36B denote memory units of the electronic unit;

numeral 38*a* denotes a rays being decreased due to absorbance of the cover 18;

numeral 38*b* denotes a ray being reflected or dispersed;

numerals 40*a*1 and 40*b*1 denote rays from the sun or another illumination source propagating from the top of the swimming pool;

numeral 40*a*2 and 40*b*2 denote rays reflected/dispersed from rays 40*a* and 40*b*1 respectively;

numeral 42 denotes a comparator of the electronic unit;

numeral 44 denotes an accelerometer, for detecting a person falling into the swimming pool;

numeral 50 denotes a compartment packaging/casing the swimming-pool entrance detector, which functions also as a float, since it houses air in a sealed manner;

numeral 52 denotes the water level;

numeral 54 denotes an alarm unit, which may include a loudspeaker and/or a transmitter and/or a visual indicator and/or a receiver, for being controlled by remote;

numeral 56 denotes the ground of the swimming pool;

numeral 58 denotes the space above the swimming pool, such as the sky or the sun or an artificial illumination source illuminating from above the swimming pool; and numeral 60 denotes the sun, providing beams/rays, which they and/or reflected rays therefrom are sensed by the swimming-pool entrance detector.

What is claimed is:

1. A swimming-pool entrance detector (10*a*), comprising:

means (50) for disposing said swimming-pool entrance detector (10*a*) in water of a swimming pool (12) above a ground (56) thereof, and a first optical sensor (30), for receiving optical rays (40*a*1, 40*a*2), wherein said first optical sensor (30) is disposed facing a ground (56), for receiving optical rays (40*a*2) reflected therefrom, thereby receipt of said optical rays (40*a*1, 40*a*2) indicates presence of at least one opening (14*a*) in a cover (18) of the swimming pool (12), and thereby said indication of the presence of the least one opening (14*a*) in the cover (18) of the swimming pool (12), is obtained even in case said swimming-pool entrance detector (10*a*) is covered by the cover (18).

2. A swimming-pool entrance detector (10*a*) according to claim 1, further comprising:

a second optical sensor (28), disposed for facing a top (58), for receiving optical rays (40*a*1) therefrom; and an electronic unit (26) for detecting a difference between optical intensities sensed by said first (30) and second (28) optical sensors, thereby presence of said difference indicates said presence of the at least one opening (14*a*) in the cover (18), while not indicating presence of an opening (14*a*) in case the cover (18) is not present or is widely open.

3. A swimming-pool entrance detector (10*a*) according to claim 1, further comprising:

an electronic unit (26) comprising a memory (36A), for detecting a difference along time between optical intensities sensed by said first (30) optical sensor, thereby a swift difference may indicate manual changing of a physical positioning of the cover (18).

4. A swimming-pool entrance detector (10*a*) according to claim 1, further comprising:

a lens (22), for directing said reflected optical rays (40*a*1) to said first optical sensor (30).

5. A swimming-pool entrance detector (10*a*) according to claim 1, wherein said means (50) for disposing said swimming-pool entrance detector (10*a*) in water above the ground (56) comprises a float (50).

6. A swimming-pool entrance detector (10*a*) according to claim 1, further comprising:

an alarm unit (54), for alarming upon said indicating of said presence of the at least one opening (14*a*) in the cover (18).

7. A swimming-pool entrance detector (10*a*) according to claim 1, further comprising:

another swimming-pool entrance detector (10*b*) according to claim 1, for disposing said swimming-pool entrance detectors (10*a*, 10*b*) distanced from one another, thereby at least one of said swimming-pool entrance detectors (10*a*) does not face the at least one opening (14*a*).

8. A swimming-pool entrance detector (10*a*) according to claim 1, further comprising:

an accelerometer (44), for detecting sudden movement, thereby said detected sudden movement indicates entrance into the swimming pool (12).

* * * * *